US009109419B2

(12) United States Patent
Fenton

(10) Patent No.: US 9,109,419 B2
(45) Date of Patent: Aug. 18, 2015

(54) PLUG INSTALLATION SYSTEM AND METHOD

(75) Inventor: Stephen Paul Fenton, Aberdeen (GB)

(73) Assignee: Vetco Gray U.K. Limited, Bridge of Don, Aberdeen (GB)

( * ) Notice: Subject to any disclaimer, the term of this patent is extended or adjusted under 35 U.S.C. 154(b) by 0 days.

(21) Appl. No.: 13/460,920

(22) Filed: May 1, 2012

(65) Prior Publication Data

US 2013/0292127 A1 Nov. 7, 2013

(51) Int. Cl.

| | |
|---|---|
| ***E21B 33/035*** | (2006.01) |
| ***E21B 33/03*** | (2006.01) |
| ***E21B 33/076*** | (2006.01) |
| ***E21B 41/10*** | (2006.01) |
| ***E21B 33/043*** | (2006.01) |
| ***E21B 34/14*** | (2006.01) |

(52) U.S. Cl.

CPC ..... *E21B 33/035* (2013.01); *E21B 33/043* (2013.01)

(58) Field of Classification Search

CPC ..... E21B 33/12; E21B 34/06; E21B 33/035; E21B 33/13; E21B 23/00; E21B 33/1208; E21B 34/14; E21B 33/124; E21B 33/03; E21B 33/043; E21B 33/068; E21B 33/076; E21B 33/134; E21B 33/143; E21B 33/16; E21B 34/02; E21B 34/066; E21B 34/102; E21B 34/105

USPC ..... 166/339, 341, 349, 351, 368, 386, 77.1, 166/85.1, 181, 192, 241.5

See application file for complete search history.

(56) References Cited

U.S. PATENT DOCUMENTS

| | | | | | |
|---|---|---|---|---|---|
| 1,448,004 | A | * | 3/1923 | Robinson | 166/192 |
| 2,187,007 | A | * | 1/1940 | Barnes | 166/241.5 |
| 2,549,728 | A | * | 4/1951 | Villines | 166/181 |
| 2,768,693 | A | * | 10/1956 | Hughes, Jr. | 166/292 |
| 2,943,682 | A | * | 7/1960 | Ingram, Jr. et al. | 166/77.1 |
| 2,999,545 | A | * | 9/1961 | Bigelow | 166/153 |
| 3,022,822 | A | * | 2/1962 | Loy Ill et al. | 166/250.01 |
| 3,071,190 | A | * | 1/1963 | Ehlert | 166/85.1 |
| 3,242,991 | A | * | 3/1966 | Johnson et al. | 166/352 |
| 3,252,515 | A | * | 5/1966 | Donaldson et al. | 166/114 |
| 3,353,364 | A | * | 11/1967 | Blanding et al. | 405/189 |
| 3,424,242 | A | * | 1/1969 | Triplett | 166/341 |

(Continued)

FOREIGN PATENT DOCUMENTS

WO 2012007407 A2 1/2012

OTHER PUBLICATIONS

GB Search Report dated Oct. 21, 2013 from corresponding GB Application No. GB1307736.7.

*Primary Examiner* — Matthew Buck
*Assistant Examiner* — Edwin Toledo-Duran
(74) *Attorney, Agent, or Firm* — Bracewell & Giuliani LLP

(57) ABSTRACT

A system for maneuvering a plug in and out of a tubing hanger mounts to a subsea wellhead assembly. The system includes a tractor and an end effector that are sheltered in a housing. A control cable spools from a reel mounted on the housing and attaches to the tractor. The control cable provides communication from a remotely operated vehicle (ROV) to the tractor and end effector so that commands from the ROV via the control cable control the tractor and end effector. After the housing connects to the wellhead assembly, control signals from the ROV activate the tractor to drive the end effector into the wellhead assembly and command the end effector to set the plug in the tubing hanger, or to remove the plug from the tubing hanger.

12 Claims, 4 Drawing Sheets

(56) References Cited

U.S. PATENT DOCUMENTS

| | | | | |
|---|---|---|---|---|
| 3,504,740 | A * | 4/1970 | Manning | 166/339 |
| 3,517,736 | A * | 6/1970 | Waldron | 166/351 |
| 3,572,432 | A * | 3/1971 | Aulick | 166/114 |
| 3,580,332 | A * | 5/1971 | Dean et al. | 166/184 |
| 3,664,423 | A * | 5/1972 | Holbert, Jr. | 166/297 |
| 4,194,857 | A * | 3/1980 | Chateau et al. | 405/203 |
| 4,503,879 | A * | 3/1985 | Lazarus | 137/315.41 |
| 4,651,818 | A * | 3/1987 | Johnson et al. | 166/115 |
| 4,830,107 | A * | 5/1989 | Rumbaugh | 166/250.07 |
| 5,787,979 | A * | 8/1998 | Giroux et al. | 166/177.4 |
| 6,179,058 | B1 * | 1/2001 | Wittrisch | 166/384 |
| 6,189,621 | B1 * | 2/2001 | Vail, III | 166/385 |
| 6,520,255 | B2 * | 2/2003 | Tolman et al. | 166/281 |
| 6,588,502 | B2 * | 7/2003 | Nice | 166/84.4 |
| 6,675,888 | B2 * | 1/2004 | Schempf et al. | 166/65.1 |
| 6,684,965 | B1 * | 2/2004 | Bakke | 175/99 |
| 6,719,059 | B2 * | 4/2004 | Dezen et al. | 166/368 |
| 6,887,014 | B2 * | 5/2005 | Holland | 405/184.1 |
| 6,915,849 | B2 * | 7/2005 | Nuth | 166/254.2 |
| 6,953,094 | B2 * | 10/2005 | Ross et al. | 166/381 |
| 7,013,997 | B2 * | 3/2006 | Vail, III | 175/318 |
| 7,036,598 | B2 * | 5/2006 | Skjaerseth et al. | 166/339 |
| 7,121,344 | B2 * | 10/2006 | Fenton et al. | 166/339 |
| 7,513,305 | B2 * | 4/2009 | Wilson et al. | 166/254.2 |
| 8,028,752 | B2 * | 10/2011 | Richards | 166/339 |
| 2003/0034177 | A1 * | 2/2003 | Chitwood et al. | 175/61 |
| 2007/0289745 | A1 * | 12/2007 | Richards | 166/339 |
| 2010/0307760 | A1 * | 12/2010 | Shouse | 166/339 |
| 2011/0315392 | A1 | 12/2011 | Edwards | |

* cited by examiner

PLUG INSTALLATION SYSTEM AND METHOD

BACKGROUND

1. Field of Invention

The invention relates generally to a system and method for handling a plug assembly. More specifically, the invention relates to a system and method for installing and/or removing a plug assembly from a tubing hanger subsea.

2. Description of Prior Art

Subsea wellhead assemblies typically have a high pressure wellhead housing supported in a lower pressure wellhead housing and secured to casing that extends into the well. Usually one or more casing hangers land in the wellhead housing, where the casing hanger being located at the upper end of a string of casing that extends into the well to a deeper depth. A string of tubing generally extends through the casing for producing fluids from the well. Most assemblies include a production tree mounted to the upper end of the wellhead housing for controlling the well fluid. Production trees are typically large and heavy, having a number of valves and controls mounted thereon.

One type of tree, which is sometimes referred to as a "conventional" tree, includes a bore for production fluids and a tubing annulus access bore. Wellhead assemblies having conventional trees are formed by landing the tubing hanger in the wellhead housing. Tubing hangers in convention trees generally have a production passage, and an annulus passage that communicates with the tubing annulus surrounding the tubing. A flow circuit is defined through the tubing annulus and production tubing, circulating fluid through the circuit can be used to kill the well or to circulate out heavy fluid during completion.

Trees that are sometimes referred to as "horizontal" trees have a single bore in the tree, which is typically the production passage. A horizontal tree is landed before its corresponding tubing hanger is installed, then the tubing hanger is lowered and landed in the tree. The tubing hanger is lowered through the riser, which is typically a drilling riser. In another common type of wellhead system, a concentric tubing hanger lands in the wellhead housing in the same manner as a conventional wellhead assembly. The tubing hanger has a production passage and an annulus passage. However, the production passage is concentric with the axis of the tubing hanger, rather than slightly offset as in conventional tubing hangers and the tree does not have vertical tubing annulus passage. Tubing hangers in vertical trees are usually installed before the tree is landed on the wellhead housing. The tubing is typically run on a landing string through the drilling riser and BOP. Before the drilling riser is disconnected from the wellhead housing, a plug is installed in the tubing hanger as a safety barrier. The plug is normally lowered on a wireline through the landing string. Subsequently, after the tree is installed, the plug is removed through an open water riser that may be used to install the tree.

SUMMARY OF THE INVENTION

Provided herein is an example of a system for maneuvering a plug in and out of a tubing hanger disposed in a subsea wellhead assembly. In an example embodiment, the system includes a housing selectively coupled with the subsea wellhead assembly; where the housing has an end with an opening that is intersected by a chamber formed in the housing. A tractor is selectively deployed from within the housing that has an attached end effector. The plug is selectively coupled with the end effector, so that when the tractor is deployed from within the housing, the end effector handles the plug in the tubing hanger. In one example, the system further includes a reel mounted on the housing, a control line spooled on the reel that has an end attached to the tractor and is in selective communication with a remotely operated vehicle deployed subsea. An optional hot stab can be mounted on the housing for connecting to the remotely operated vehicle. In one optional example, the chamber registers with a main bore in the subsea wellhead assembly when the housing is coupled with the subsea wellhead assembly. The tractor in one example includes wheel members that project radially outward and into urging contact with an inner surface of the chamber when the tractor is in the housing and into urging contact with a main bore in the subsea wellhead assembly when the tractor is deployed from within the housing. An upper end of the chamber may optionally be subsea. In one embodiment, a seal is defined along an interface between the housing and the wellhead assembly.

Also provided herein is an example of a system for plugging a tubing hanger in a subsea wellhead assembly that in an embodiment includes a housing with an open end. In this example, the housing further includes a base at the open end that is sealingly attachable to the wellhead assembly and a closed end opposite the open end. A chamber in the wellhead assembly intersects the open end. A plug tooling assembly is selectively deployable from within the chamber. In an embodiment, the plug tooling assembly is made up of a tractor, an end effector mounted on the tractor, and a plug releasably connected to the end effector. The open end of the housing can attach to the wellhead assembly and the closed end may be disposed subsea. A control cable may optionally be included that provides power and control signals to the plug tooling assembly. In an example, the control cable has an end coupled with the plug tooling assembly and is in communication with a remotely operated vehicle disposed subsea. In an example embodiment, the control cable extends along a passage formed through the closed end and wherein packoffs in the passage define a pressure barrier between the cavity and ambient to the housing. Proximity sensors may optionally be set in the housing and the plug for determining a location of the plug in the housing.

Yet further provided herein is a method of handling a plug in a tubing hanger of a subsea wellhead assembly. In one example the method includes enclosing a tractor with an attached end effector in a housing, mounting the housing onto the wellhead assembly so that an upper end of the housing is submerged subsea, deploying the tractor and end effector from the housing into a main bore in the wellhead assembly, and handling the plug in the tubing hanger with the end effector. In one optional example of the method, the step of deploying the tractor involves engaging wheels on the tractor with an inner surface of the housing and an inner surface of the main bore. The method may further include deploying a remotely operated vehicle subsea, engaging a connector on the housing with the remotely operated vehicle, and controlling the tractor and end effector from the remotely operated vehicle through the connector.

BRIEF DESCRIPTION OF DRAWINGS

Some of the features and benefits of the present invention having been stated, others will become apparent as the description proceeds when taken in conjunction with the accompanying drawings, in which.

Figure 1:
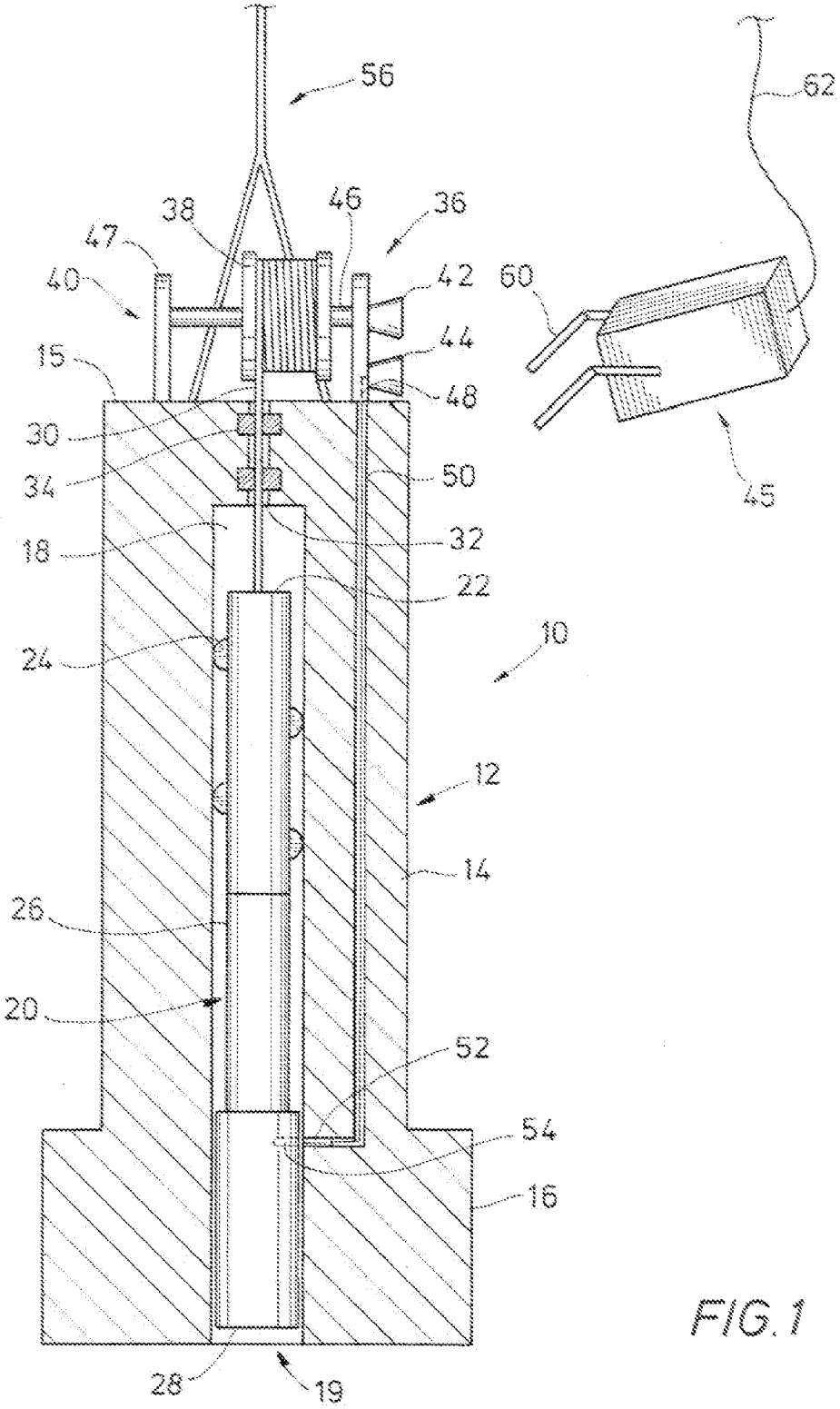
FIG. 1 is a side partial sectional view of an example of a plug installation package in accordance with the present invention.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation. Accordingly, the improvements herein described are therefore to be limited only by the scope of the appended claims.

An example of a wellhead plug tooling package 10 is shown in a partial side sectional view in FIG. 1; which includes a housing 12 shown made up of a shroud 14 with a substantially cylindrical outer surface and a closed end 15 on its upper end. Opposite the closed end 15 is a connector 16 that also has a substantially cylindrical outer surface and an outer diameter extending radially outward past an outer diameter of the shroud 14. In one example, connector 16 is a type conventionally used in subsea applications. A chamber 18 is shown extending axially through the shroud 14 and connector 16 which intersects an open end 19 disposed on a lower end of the connector 16. Stowed within the chamber 18 is a plug tooling assembly 20; which in the example of FIG. 1 includes a tractor 22 having wheels 24 that selectively extend radially outward from an axis of the tractor 22. An end effector 26 mounts on a lower end of the tractor 22 of FIG. 1 and is shown having a plug 28 is set on its lower end and on a side opposite where the end effector 26 connects with tractor 22.

An optional control cable 30 is shown extending through a passage 32, where the passage 32 is formed substantially axially through the closed end 15. Examples of the control cable 30 include a wireline, slickline, cable, and other elements for deploying devices subsea and/or for conveying signals therein. Optional packoffs 34 are illustrated set coaxial within the passage 32 that extend from grooves in the wall of the passage 32 radially inward into the annular space defined between the control cable 30 and surfaces of the passage 32. In one example of operation, the control cable 30 slides axially within the packoffs 34, while the packoffs 34 provide a pressure barrier between the chamber 18 and area ambient to the housing 12, so that when the wellhead plug tooling package 10 is disposed subsea, seawater is prevented from entering the chamber 18 while yet the control cable 30 is able to axially move within the passage 32.

A reel assembly 36 mounts on the housing 12 over the closed end 15 and includes a spool 38. A length of control cable 30 is shown rolled up on the spool 38 and the spool is supported on a frame 40. Hot stabs 42, 44 are shown set on the frame 40 and are configurable to be engaged by a remotely operated vehicle (ROV) 45 shown disposed adjacent the wellhead plug tooling package 10. A spindle 46 is included with the frame that extends laterally between vertical members 47 that have lower ends that mount axially onto an upper surface of the closed end 15. A signal line 48 is shown having an upper end terminating into and connecting with hot stab 44; the signal line 48 is disposed in a passage 50 shown extending axially a distance through the shroud 12 and into the connector 16, then running radially inward within connector 16 and intersect with an inner surface of the chamber 18. Proximity sensor 52 is shown provided in the end of the passage 50 distal from hot stab 44, and proximity sensor 54 is illustrated in plug 28. In the example of FIG. 1, the plug 28 is adjacent the lower terminal end of passage 50 so that proximity sensors 52, 54 are disposed facing one another. In this position, the position of the plug 28 can be sensed by interaction of the proximity sensors 52, 54 that in turn creates a signal through the signal line 48. It is within the capabilities of those skilled in the art to implement proximity sensors that sense the presence of one another.

A cable 56 is shown mounted on the closed end 15, that in one example of operation provides for deploying the wellhead plug tooling package 10 from above the sea surface, such as from a vessel or platform (not shown). Further, the ROV 45 can be used to provide guidance support when deploying the wellhead plug tooling package 10 on the cable 56. In this example, actuator arms 60 on the ROV 45 may grapple the wellhead plug tooling package 10 during deployment. Also, the ROV 45 can be controlled from surface by an attached control line 62.

Figure 2:
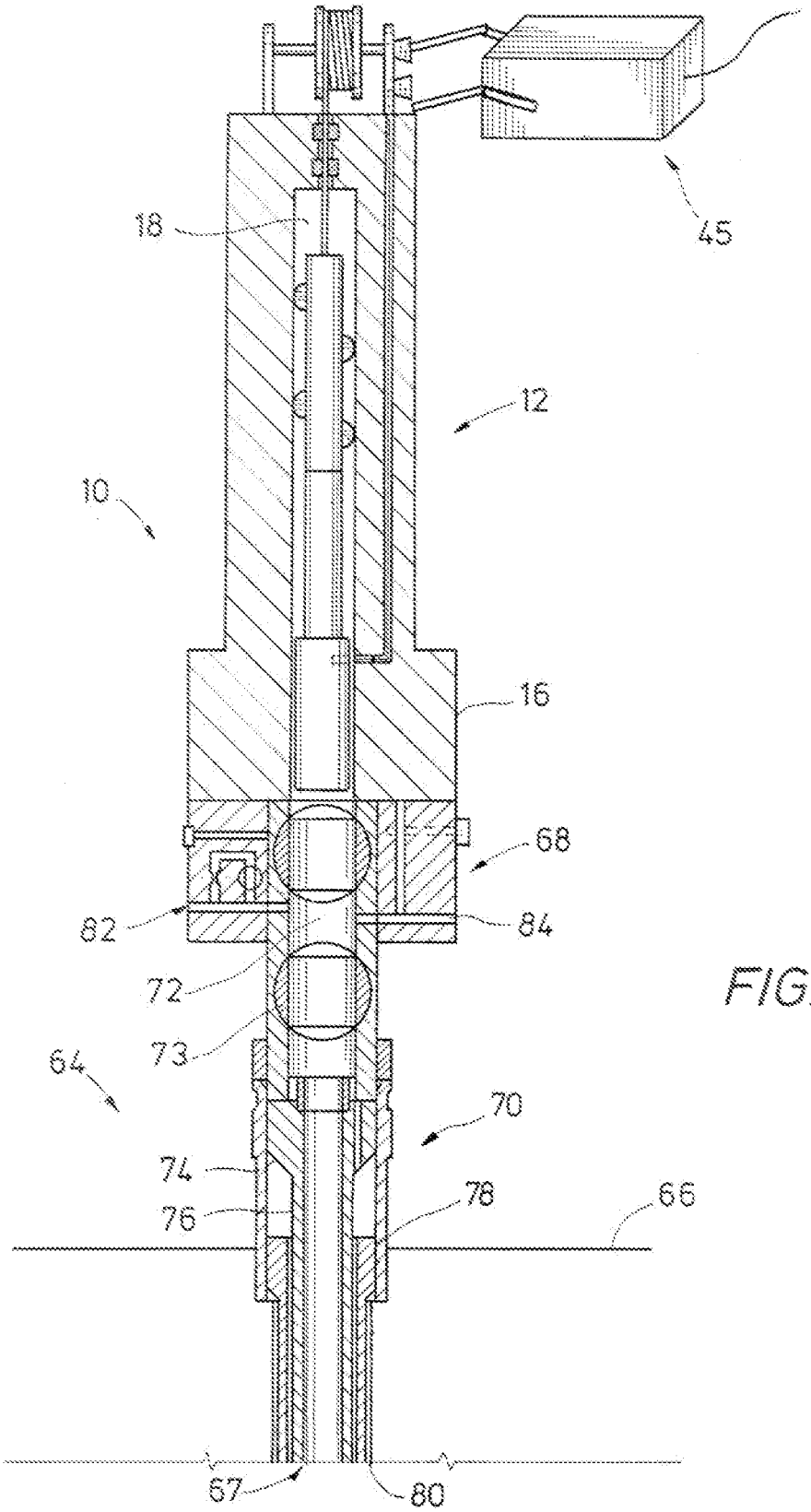
FIG. 2 is a side partial sectional view of an example of the plug installation package of FIG. 1 being set onto a wellhead assembly in accordance with the present disclosure.

Referring now to FIG. 2, an example of the wellhead plug tooling package 10 is shown landed on an upper end of a wellhead assembly 64 that is subsea. The wellhead assembly 64 is mounted into a subsea formation 66, which is intersected by a wellbore 67 that is in fluid communication with the wellhead assembly 64. A production tree 68 is included on an upper end of the wellhead assembly 64 and shown mounted onto a wellhead housing 70; where a lower end of the wellhead housing 70 anchors in the formation 66. A main bore 72 in the wellhead assembly 64 (and tree 68) registers with the wellbore 67 to provide communication between the wellbore 67 and wellhead assembly 64. Valves 73 are illustrated in the main bore 72 for controlling flow through the main bore 72. A tubing hanger 74 is shown landed within the wellhead housing 70; a length of tubing 76 depends downward from the tubing hanger 74 and into the wellbore 67. Shown landed in a portion of the wellhead housing 70 beneath the tubing hanger 74, is a casing hanger 78 that circumscribes the tubing 76. A length of casing 80 depends downward from the casing hanger 78 into the wellbore 67, which also circumscribes the tubing 76. Shown extending radially outward from the main bore 72 and through the production tree 68 are a production line 82 and auxiliary line 84.

Figure 3:
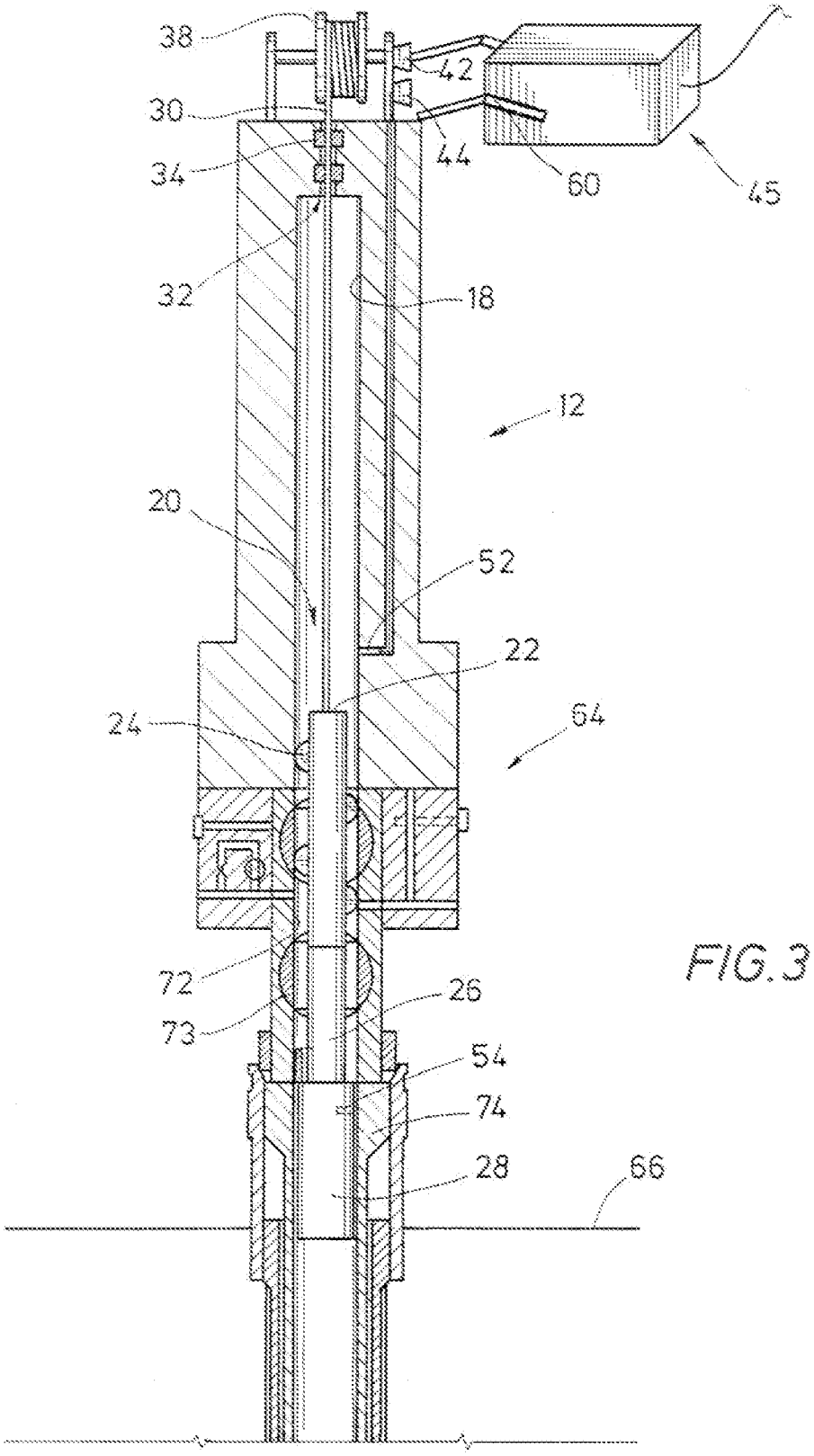
FIGS. 3 and 4 are side partial sectional views of an example of the plug installation package installing a plug in a tubing hanger of a wellhead assembly in accordance with the present invention.

Referring now to FIG. 3, the plug tooling assembly 20 is shown having been deployed downward from the housing 12 and into the main bore 72. In one example, deploying the plug tooling assembly 20 is accomplished by activating a motor (not shown) within the tractor 22 that in turn drives the wheels 24. Contacting the rotating wheels 24 against the walls of the chamber 82 and main bore 72 downwardly urge the plug tooling assembly 20 into the wellhead assembly 64. Further, in the example of FIG. 3, valves 73 are actuated to an open position thereby allowing passage there through of the plug tooling assembly 20. Further in the example of FIG. 3, the plug 28 is shown set within the tubing hanger 74 and in a position for plugging the wellhead assembly 64. Setting the plug 28 in the tubing hanger 74 as shown defines a flow barrier within the main bore 72. Further illustrated is how proximity sensors 52, 54 are axially spaced apart from one another, so that by monitoring signals from proximity sensor 52 as described above, it can be confirmed that the plug 28 has deployed from within the housing 12.

Further illustrated in the example of FIG. 3, that that arm 60 of the ROV 45 is engaging hot stab 42 thereby creating communication from the ROV 45 into the plug tooling assembly 20. Communication between ROV 45 and plug tooling assembly 20 is via a connection between a receptacle (not shown) in hot stab 42 and plug (not shown) in arm 60, and communication through control cable 30. Examples of operation exist wherein the plug tooling assembly 20 is gravity deployed from the housing 12 and into the wellhead assembly 64 instead of, or in addition to, activation of the wheels 24 on tractor 22.

Figure 4:
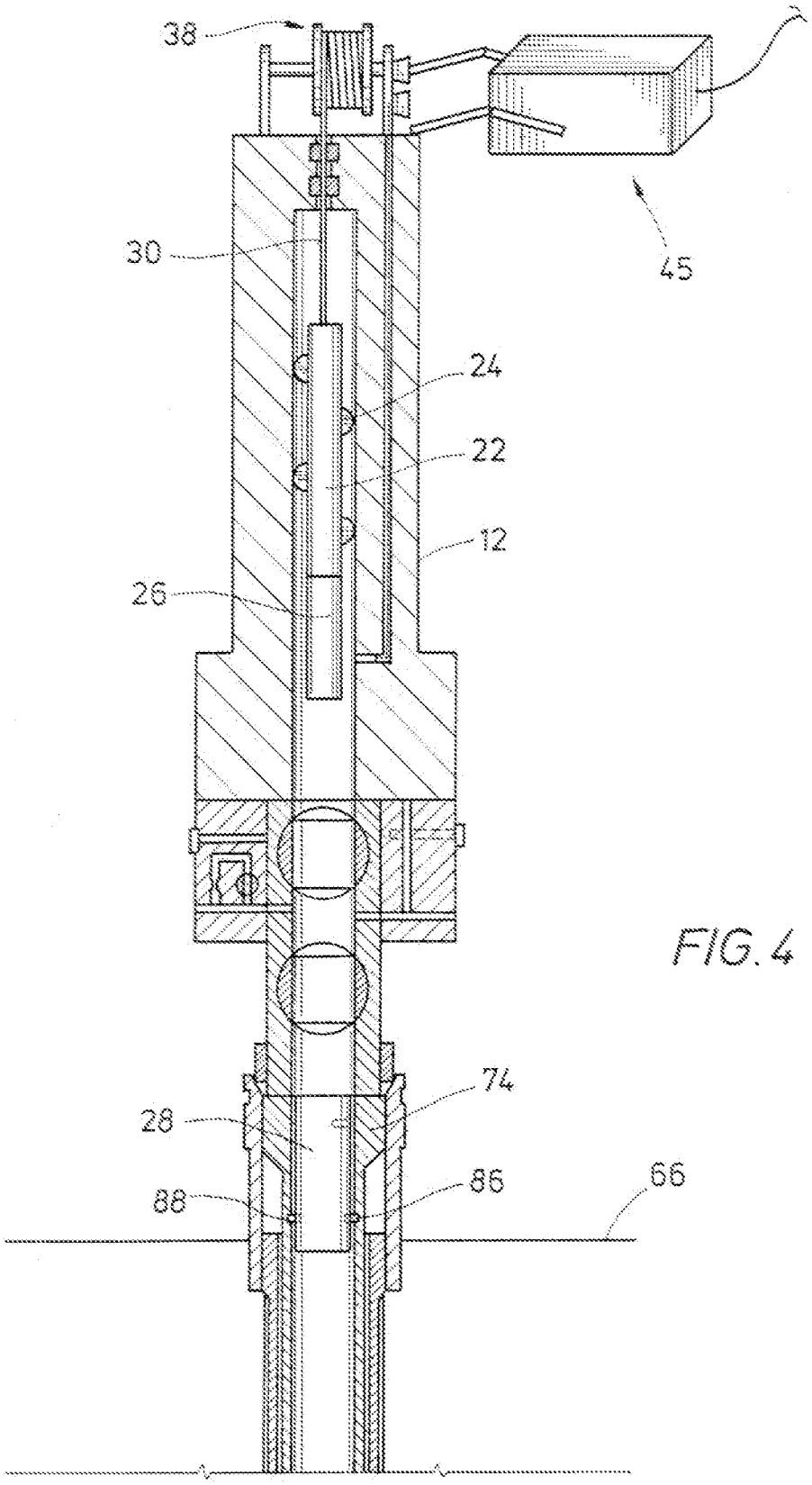

FIG. 4 illustrates in a side partial side sectional view that tractor 22 and end effector 26 have been retracted within housing 12 leaving plug 28 within tubing hanger 74. In the example of FIG. 4, latches 86 are shown extended radially outward and within a profile 88 provided on an inner surface of the tubing hanger 74. In one example, the latches 86 are deployed via mechanical operation of the end effector 26. An example of an end effector 22 suitable for use herein can be found in U.S. Pat. No. 7,121,344 issued Oct. 17, 2006, and assigned to the assignee of the present application. U.S. Pat. No. 7,121,344 is incorporated by reference herein in its entirety for all purposes. In another example, the plug 28 of FIG. 4 can be retrieved from within tubing hanger 74 by reversing the above described process, that is landing the housing 12 with enclosed tractor 22 and end effector 26, deploying the tractor 22, and end effector 26 into tubing hanger 74, retracting the latches 86 from within the grooves 88, and coupling the end effector 26 with plug 28. Once attached to the end effector 26, the plug can be removed from within tubing hanger 74 by drawing the tractor 22 and end effector 26 back into the housing 22. The position of the plug within the housing 12 may be confirmed when proximity sensor 52, 54 are appropriately positioned thereby providing a signal through signal line 48, which may optionally be monitored by ROV 45 via its optional connection to hot stab 44 (FIG. 1). In one example, after confirming the plug 28 is within housing 12, the housing 12 can be detached from the wellhead assembly 64 and removed therefrom so that production from the wellbore 67 can be initiated.

Advantages of the system and method described herein include retrieving a plug from a tubing hanger without the need for a riser extending to the surface. Because a riser is unnecessary, a production tree can be efficiently removed on a lift wire (not shown). An example of this is provided in U.S. Pat. No. 6,968,902 issued Nov. 29, 2005, and assigned to the assignee of the present application. U.S. Pat. No. 6,968,902 is incorporated by reference herein in its entirety for all purposes. Moreover, because installing and/or removing the plug can be accomplished by use of an ROV 45, an umbilical to the surface for the plug tool is unnecessary.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, the tool may be additionally used to install/retrieve at least another plug set below the tubing hanger at a lower depth within the production tubing system. These and other similar modifications will readily suggest themselves to those skilled in the art, and are intended to be encompassed within the spirit of the present invention disclosed herein and the scope of the appended claims.

What is claimed is:

1. A system for maneuvering a plug in and out of a tubing hanger that is disposed in a vertical bore of the subsea wellhead assembly, the vertical bore having a vertical axis, the system comprising:

a housing selectively lowered subsea and coupled with the subsea wellhead assembly, and that comprises a lower end with an opening;

a chamber in the housing intersecting the opening, the chamber having a vertical wall adapted to be coaxial with the axis when the housing is coupled with the subsea wellhead assembly;

a tractor selectively deployed along the vertical axis from within the chamber of the housing into the vertical bore of the subsea wellhead assembly and that comprises crawler members that extend radially outward from an axis of the tractor and into rolling contact against the vertical wall of the chamber for moving the tractor into and out of the vertical bore of the subsea wellhead assembly, and a motor that drives the crawler members;

a reel mounted on the housing;

a control cable spooled on the reel that has an end attached to the tractor and is in selective communication with a remotely operated vehicle (ROV) deployed subsea via a control hot stab on the reel;

an end effector mounted to the tractor and selectively coupled with the plug, so that when the tractor is deployed from within the housing and located in the vertical bore of the subsea wellhead assembly, the end effector handles deploying the plug into the tubing hanger; and wherein the control hot stab on the reel enables the ROV to control the tractor and the end effector.

2. The system of claim 1, wherein tractor and the end effector define a plug tooling assembly, and wherein the ROV communicates with the plug tool assembly through the control cable and the control hot stab on the reel.

3. The system of claim 2, further comprising:

at least one signal hot stab mounted on the housing for connecting to the remotely operated vehicle;

a proximity sensor mounted in the housing adjacent the chamber and connected to the signal hot stab via a signal line; and wherein the proximity sensor provides a signal through the signal line and the signal hot stab to the remotely operated vehicle indicating a position of the tractor within the chamber.

4. The system of claim 1, wherein the crawler members comprise wheels.

5. The system of claim 1, wherein the crawler members extend from opposite sides of the tractor in urging contact with opposite sides of the vertical wall of the chamber when the tractor is in the housing and are adapted to be in urging contact with opposite sides of the vertical bore in the subsea wellhead assembly when the tractor is deployed into the vertical bore of the subsea wellhead assembly.

6. The system of claim 1, wherein the housing is adapted to be deployed from above the sea surface on a cable.

7. The system of claim 1, wherein an upper end of the chamber is enclosed and isolates the chamber from a subsea environment.

8. A system for plugging a tubing hanger in a subsea wellhead assembly having a vertical bore with a vertical axis, comprising:

a housing comprising an open end, a connector at the open end that is sealingly attachable to the subsea wellhead assembly, a closed end opposite the open end, and a chamber that intersects the open end, the chamber adapted to be coaxial with the vertical bore when the housing is attached to the subsea wellhead assembly;

a reel assembly mounted on the closed end of the housing;

a plug tooling assembly selectively deployable from within the chamber into the vertical bore, the plug tooling assembly comprising;

a tractor having a motor and wheels driven by the motor and on opposite sides of the tractor, the tractor being vertically oriented with the wheels in frictional engagement with opposite sides of a wall of the chamber while the tractor is in an upper position, the wheels adapted to be in frictional engagement with the vertical bore while the tractor is within the subsea wellhead;

an end effector mounted on the tractor; and a plug releasably connected to the end effector;

a control cable mounted on the reel assembly and extending sealingly through a passage in the closed end of the housing into engagement with the plug tooling assembly for providing control signals to the plug tooling assembly;

a control hot stab on the reel assembly for engagement by a remote operated vehicle (ROV) deployed subsea, the control hot stab being in communication with the control cable to allow the ROV to control the plug tooling assembly;

wherein providing power to the tractor causes the wheels to move the plug tooling assembly from the chamber into and out of the vertical bore of the subsea wellhead assembly; and the end effector is controllable by the ROV via the hot stab to deploy the plug while the end effector is located in the vertical bore of the subsea wellhead assembly.

9. The system of claim 8, further comprising a packoff in the passage that defines a pressure barrier.

10. The system of claim 8, further comprising:

at least one signal hot stab mounted on the housing for connecting to the ROV;

a proximity sensor mounted in the housing adjacent the chamber and connected to the signal hot stab via a signal line; and wherein the proximity sensor is adapted to provide a signal through the signal line and signal hot stab to the ROV indicating a position of the plug.

11. A method of handling a plug in a tubing hanger in a vertical bore of a subsea wellhead assembly, the method comprising:

providing a tractor having a motor, crawler members driven by the motor, and an end effector;

enclosing the tractor in a chamber in a housing having a reel mounted to the housing, and a control line spooled on the reel, the crawler members of the tractor being in engagement with a wall of the chamber;

providing a control hot stab on the reel that is connected to the control line;

coupling an end of the control line with the tractor;

mounting the housing onto the subsea wellhead assembly so that an upper end of the housing is submerged subsea and the chamber is oriented vertically above the bore in the subsea wellhead assembly;

engaging the control hot stab with a remote operated vehicle (ROV); then deploying the tractor and end effector downward from the chamber in the housing into the vertical bore in the subsea wellhead assembly by communicating signals from the ROV to the tractor via the control line that in turn activates the motor to drive the crawler members in a first direction, which roll along the wall of the chamber and along a wall of the vertical bore of the subsea wellhead assembly;

while the end effector is located in the vertical bore of the subsea wellhead assembly, deploying the plug into the tubing hanger with the end effector by communicating signals from the ROV to the end effector via the control line; then deploying the tractor and end effector upward from the bore of the subsea wellhead assembly into the chamber by activating the motor with the ROV to drive the wheels in a second direction, which roll along the wall of the vertical bore of the subsea wellhead assembly and lift the tractor and end effector upward into the chamber.

12. The method of claim 11, further comprising:

mounting a proximity sensor in the housing adjacent the chamber and connecting the proximity sensor to a signal line that has a signal hot stab;

engaging the ROV with the signal hot stab; and providing a signal from the proximity sensor through the signal line and signal hot stab to the ROV indicating a position of the plug while the tractor and end effector are within the chamber.

* * * * *